US011673793B2

(12) United States Patent
Gray et al.

(10) Patent No.: US 11,673,793 B2
(45) Date of Patent: Jun. 13, 2023

(54) FLUID DISPENSING DEVICE WITH TAPERED NOZZLE

(71) Applicants: John M. Gray, Cincinnati, OH (US); Timothy M. Garrison, Cincinnati, OH (US); Brenton T. Hershner, West Chester, OH (US)

(72) Inventors: John M. Gray, Cincinnati, OH (US); Timothy M. Garrison, Cincinnati, OH (US); Brenton T. Hershner, West Chester, OH (US)

(73) Assignee: OPW FUELING COMPONENTS, LLC, Hamilton, OH (US)

( * ) Notice: Subject to any disclaimer, the term of this patent is extended or adjusted under 35 U.S.C. 154(b) by 455 days.

(21) Appl. No.: 16/875,492

(22) Filed: May 15, 2020

(65) Prior Publication Data

US 2020/0277182 A1 Sep. 3, 2020

Related U.S. Application Data

(62) Division of application No. 15/226,359, filed on Aug. 2, 2016, now Pat. No. 10,669,149.

(51) Int. Cl.
*B67D 7/52* (2010.01)
*B67D 7/04* (2010.01)
*B67D 7/54* (2010.01)

(52) U.S. Cl.
CPC ..... *B67D 7/52* (2013.01); *B67D 7/04* (2013.01); *B67D 7/54* (2013.01)

(58) Field of Classification Search
CPC ... B67D 7/42; B67D 7/52; B67D 7/54; B67D 7/04
See application file for complete search history.

(56) References Cited

U.S. PATENT DOCUMENTS 2,582,195 A ‡ 1/1952 Duerr ..... B67D 7/48 141/20
3,085,600 A ‡ 4/1963 Briede ..... B67D 7/48 141/20

(Continued)

FOREIGN PATENT DOCUMENTS

DE 19638845 4/1997

OTHER PUBLICATIONS

"Vapor Recovery Test Procedure, TP—201.2D, Post-Fueling Drips from Nozzles", by California Environmental Protection Agency, Air Resources Board (2001).

*Primary Examiner* — Timothy P. Kelly
(74) *Attorney, Agent, or Firm* — Thompson Hine LLP

(57) ABSTRACT

A fluid dispensing nozzle system including a nozzle body having a fluid path therein and a fluid valve positioned in the fluid path and configured to selectively prevent or allow a flow of fluid through the fluid path. The nozzle further includes a manually operable actuator operatively connectable to the fluid valve, and a spout coupled to the nozzle body, the spout having a cavity to allow fluid flowing through the fluid path to pass through the spout. The spout includes a first segment having a first cross sectional area at at least a portion thereof and a second segment having a second cross sectional area at at least a portion thereof that is different than the first cross sectional area. The first segment has transition portion which transitions along a length thereof from the first cross sectional area at one end thereof to the second cross sectional area at a second opposite end thereof, wherein the first segment is made of a separate piece of material than the second segment.

27 Claims, 13 Drawing Sheets

(56) References Cited

U.S. PATENT DOCUMENTS 4,062,480 A ‡ 12/1977 Bjorklund ..... B67D 7/42 222/57
4,113,153 A ‡ 9/1978 Wellman ..... B67D 7/3209 141/28
4,213,488 A ‡ 7/1980 Pyle ..... B67D 7/42 141/1
RE30,532 E ‡ 3/1981 Buckner ..... F16K 15/038 137/51
4,453,578 A ‡ 6/1984 Wilder ..... B67D 7/48 141/20
5,377,729 A ‡ 1/1995 Reep ..... B67D 7/52 141/20
5,603,364 A ‡ 2/1997 Kerssies ..... B67D 7/48 141/20
5,620,032 A ‡ 4/1997 Dame ..... B67D 7/3209 137/84
5,645,116 A ‡ 7/1997 McDonald ..... B67D 7/52 141/20
6,311,742 B1 ‡ 11/2001 Nusen ..... B67D 7/48 141/19
6,520,222 B2 ‡ 2/2003 Carmack ..... B67D 7/52 141/20
6,676,029 B2 ‡ 1/2004 Mitchell ..... B67D 7/42 239/1
6,810,920 B1 ‡ 11/2004 Rolling ..... B67D 7/005 137/52
6,835,223 B2 ‡ 12/2004 Walker ..... B01D 53/22 141/44
6,854,491 B1 ‡ 2/2005 Knight ..... B67D 7/54 141/20
6,941,984 B2 ‡ 9/2005 Knight ..... B67D 7/3209 141/20
6,983,772 B1 ‡ 1/2006 Lawrence ..... B67D 7/421 141/31
6,997,220 B1 ‡ 2/2006 Knight ..... B67D 7/3209 141/20
7,036,536 B1 ‡ 5/2006 Knight ..... B67D 7/3209 137/31
7,063,112 B2 ‡ 6/2006 Fink, Jr ..... B67D 7/54 141/2
7,134,580 B2 ‡ 11/2006 Garrison ..... B67D 7/48 222/56
7,216,680 B2 ‡ 5/2007 Lawrence ..... B67D 7/421 137/31
7,228,870 B1 ‡ 6/2007 Sutera ..... B67D 7/42 137/53
7,234,614 B1 ‡ 6/2007 Knight ..... B67D 7/42 137/31
7,270,154 B2 ‡ 9/2007 Walker ..... B01D 53/22 141/20
7,607,459 B2 ‡ 10/2009 Treen, Jr. ..... B67D 7/52 141/31
7,735,529 B2 ‡ 6/2010 Lawrence ..... B67D 7/54 141/31
7,748,419 B2 ‡ 7/2010 Fink, Jr ..... B67D 7/42 141/31
8,066,037 B2 ‡ 11/2011 Lawrence ..... B67D 7/421 141/31
8,171,965 B2 ‡ 5/2012 Burris ..... F16K 23/00 141/31
8,616,252 B2 ‡ 12/2013 Clever ..... B67D 7/54 141/30
8,662,119 B2 ‡ 3/2014 Burris ..... F16K 15/033 141/31
2014/0096868 A1 ‡ 4/2014 Garrison ..... B67D 7/54 141/31
2015/0007907 A1 * 1/2015 Benscoter ..... B67D 7/46 141/206

* cited by examiner
‡ imported from a related application

FLUID DISPENSING DEVICE WITH TAPERED NOZZLE

This application is a divisional of U.S. patent application Ser. No. 15/226,359, filed on Aug. 2, 2016 and entitled Dispensing Nozzle with Drip Reduction, the entire contents of which are hereby incorporated by reference.

The present invention is directed to a fluid dispensing device, and more particularly, to a fuel dispensing device with a tapered nozzle.

BACKGROUND

Fluid and fuel dispensers are widely utilized to dispense fluid and/or fuels, such as gasoline, diesel, biofuels, blended fuels, ethanol or the like, into the fuel tank of a vehicle or other fuel receptacles. Such dispensers typically include a nozzle that is insertable into the fuel tank of the vehicle or other receptacle in a dispensing position. When refueling operations are completed, the nozzle is removed from the fuel tank/receptacle and is typically holstered or stored in a generally vertical configuration. It may be desired to reduce or minimize dripping when dispensing operations are stopped. In particular, any drips from the nozzle can land on the operator, vehicle/receptacle or ground surface, resulting in wasted fuel and potentially adverse environmental effects.

SUMMARY

In one embodiment the present invention is a fluid dispensing nozzle system including a nozzle body having a fluid path therein and a fluid valve positioned in the fluid path and configured to selectively prevent or allow a flow of fluid through the fluid path. The nozzle further includes a manually operable actuator operatively connectable to the fluid valve, and a spout coupled to the nozzle body, the spout having a cavity to allow fluid flowing through the fluid path to pass through the spout. The spout includes a first segment having a first cross sectional area at at least a portion thereof and a second segment having a second cross sectional area at at least a portion thereof that is different than the first cross sectional area. The first segment has transition portion which transitions along a length thereof from the first cross sectional area at one end thereof to the second cross sectional area at a second opposite end thereof, wherein the first segment is made of a separate piece of material than the second segment.

DETAILED DESCRIPTION

Basic Operations

Figure 1:
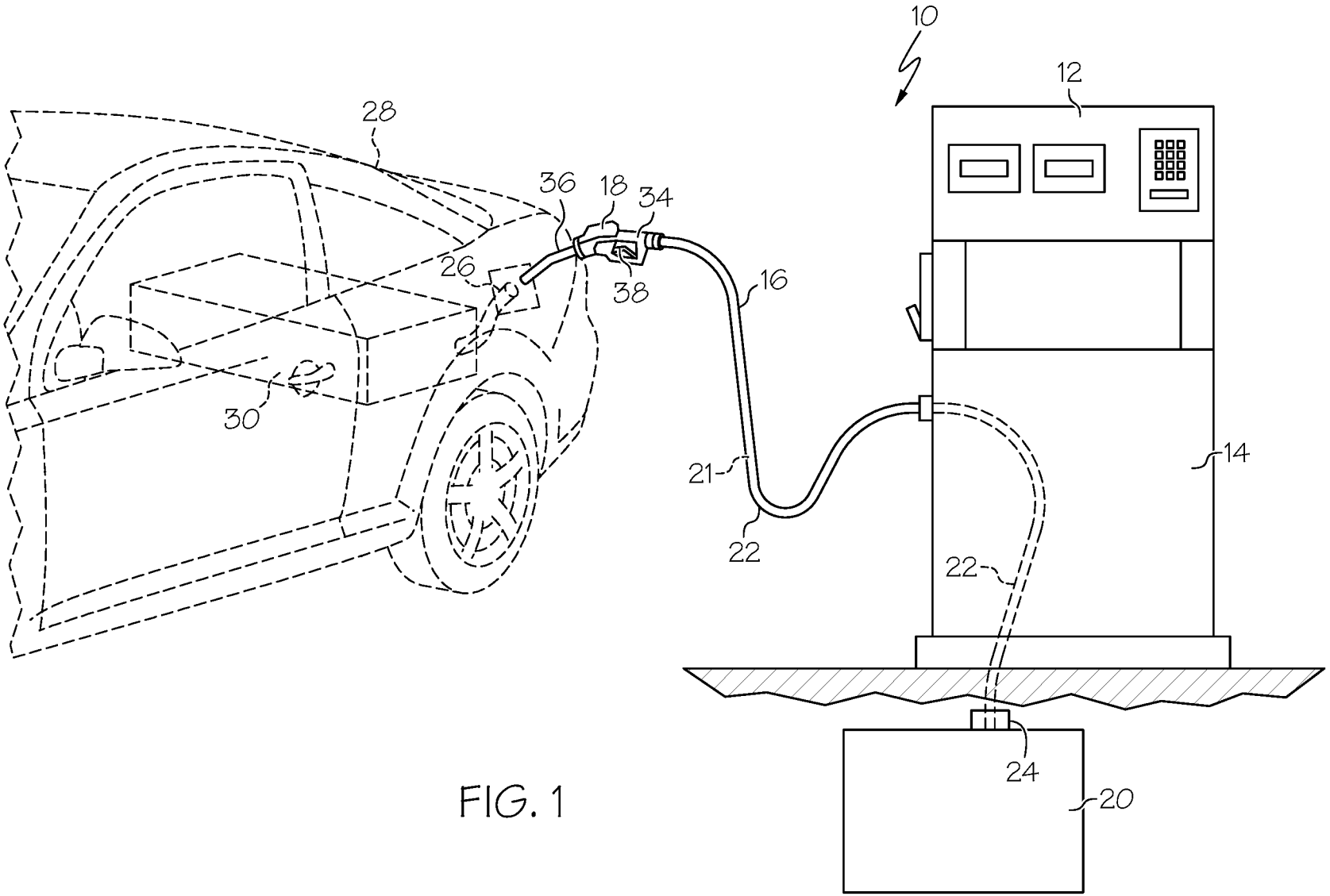
FIG. 1 is a schematic representation of a refilling system with the nozzle in a dispensing position.

FIG. 1 is a schematic representation of a refilling system 10 including a dispenser 12. The dispenser 12 includes a dispenser body 14, a hose 16 coupled to the dispenser body 14, and a nozzle 18 positioned at the distal end of the hose 16. The hose 16 may be generally flexible and pliable to allow the hose 16 and nozzle 18 to be positioned in a convenient refilling position as desired by the user/operator.

The dispenser 12 is in fluid communication with a fuel/fluid storage tank 20 via a fluid conduit 22 that defines at least partially a fluid path/flow path 21 therein, and extends from the dispenser 12 to the storage tank 20. The storage tank 20 can include or be fluidly coupled to a pump 24 which is configured to draw fluid/fuel out of the storage tank 20 and supply the fluid to the dispenser 12/nozzle 18. The nozzle 18 can be inserted into a fill pipe 26 of a vehicle 28 and operated to fill/refuel a fuel tank 30 of the vehicle 28, or to fill some other fuel/fluid containment vessel.

The nozzle 18/dispenser 12 can also be configured to capture and route vapors being expelled from the storage tank 20 during refueling via a vapor recovery system (not shown). In this case the nozzle 18 and hose 16 can each include a vapor recovery path (not shown) that is fluidly isolated from the fluid path 21. The system 10 and nozzle 18 can be utilized to store/dispense any of a wide variety of fluids, liquids or fuels, including but not limited to petroleum-based fuels, such as gasoline, diesel, biofuels, blended fuels, ethanol, compressed natural gas ("CNG"), liquefied petroleum gas ("LPG") and the like.

Figure 2:
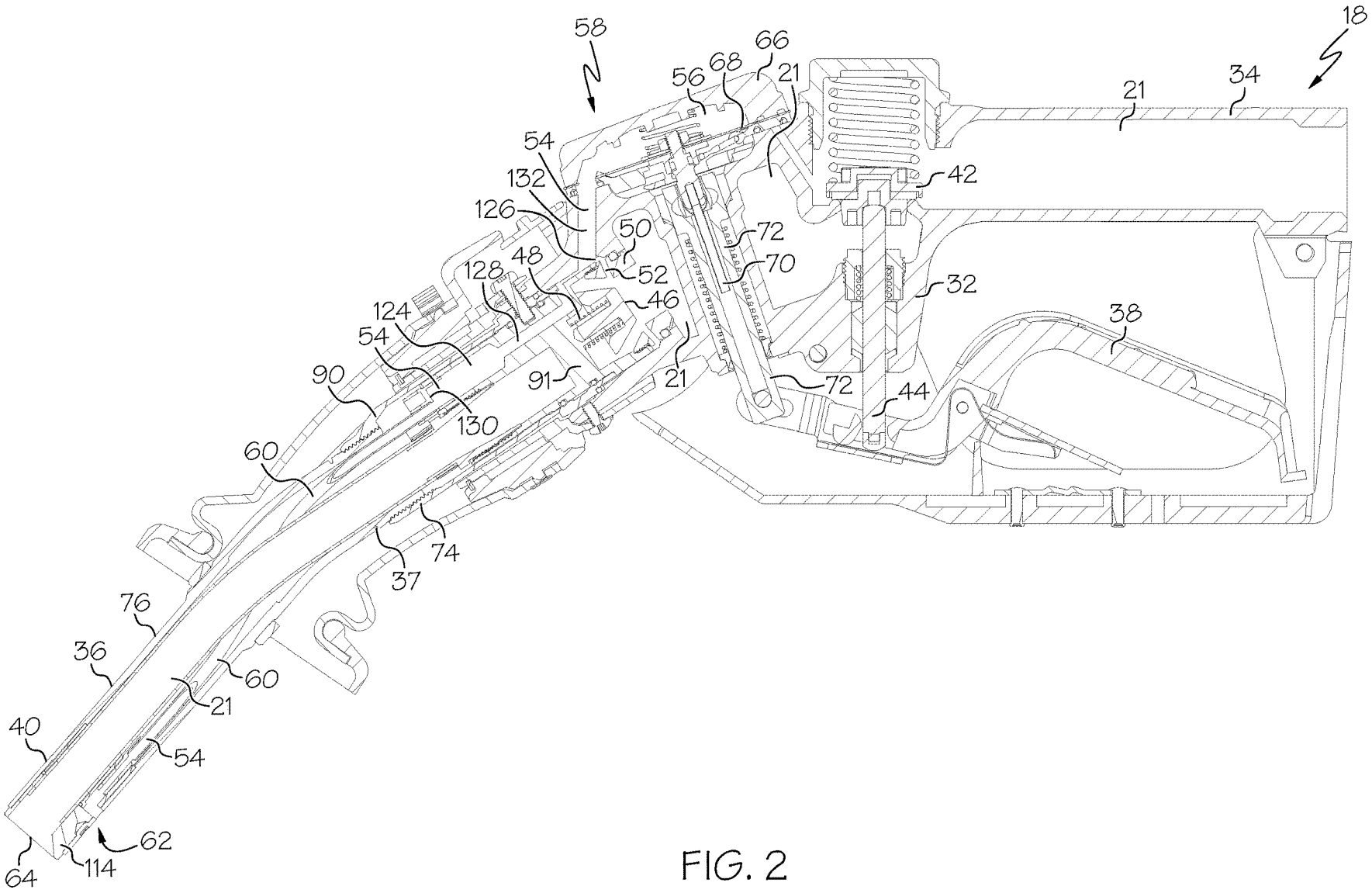
FIG. 2 is a side cross section of a nozzle of the system of FIG. 1, with the nozzle in a dispensing position.

With reference to FIG. 2, the nozzle 18 may include a nozzle body 32 having a generally cylindrical inlet 34 leading directly to or forming part of the fluid path 21. The inlet 34 is configured to be connected to an associated hose 16, such as by threaded attachment. The nozzle includes a spout or spout shell 36 having a base or straight portion 37 and an end portion 40 that is angled downwardly relative to the base portion 37 when the nozzle 18 is in its dispensing configuration. Certain features of the spout 36 are disclosed in U.S. Pat. No. 7,134,580, the entire contents of which are incorporated by reference herein.

Figure 3:
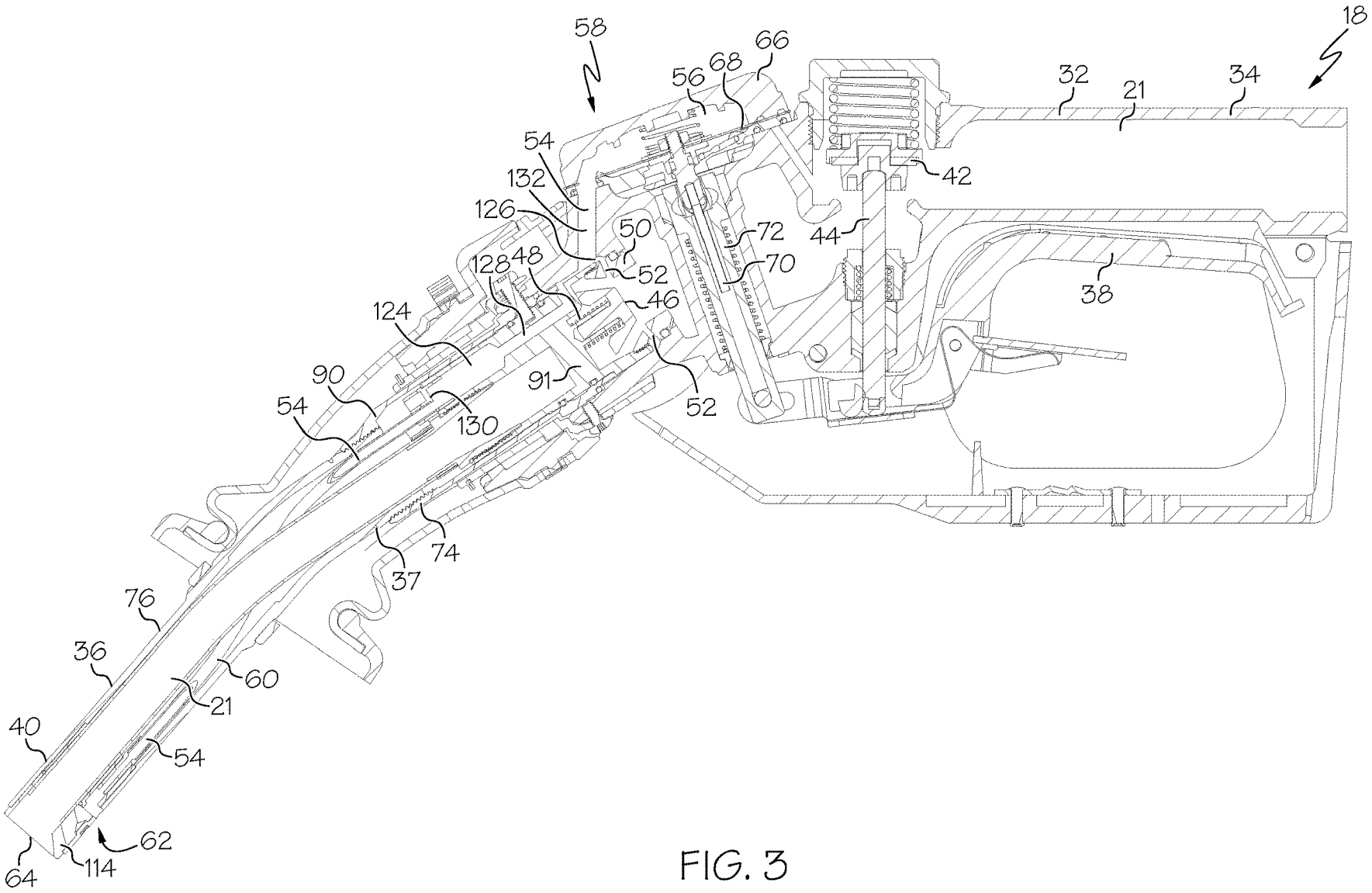
FIG. 3 is a side cross section of the nozzle of FIG. 2 with the lever raised and the fluid valve and venturi poppets opened.

When the nozzle 18/nozzle body 32 is oriented generally horizontally or in a dispensing position, the portions of the fluid path 21 immediately adjacent to the inlet 34 and/or the axis of the inlet 34 may be oriented generally horizontally, as shown in FIGS. 1-3. In addition, when the nozzle 18 is in the dispensing position, part or all of a handle/lever/actuator 38 of the nozzle 18 can be positioned above a distal end 64 of the spout 36. The end portion 40 of the spout 36 may be angled downwardly, and form an angle of at least about thirty degrees with horizontal when the nozzle 18 is in the dispensing position. The end portion 40 of the spout 36 may have an outer nominal diameter of, in one case, about 13/16", or other sizes as desired, to comply with relevant regulations and ensure the spout 36 fits into standard fill pipes 26. The nozzle 18 is also movable to a holstered or vertical position in which the nozzle 18 can be stored. In this case the portions of the fluid path 21 immediately adjacent to the inlet 34 and/or the axis of the inlet 34 may be oriented generally vertically, and/or the distal end of the spout 36 can be positioned above the lever 38.

The nozzle 18 can include a fluid valve 42 positioned in the fluid path 21 to control the flow of fluid to be dispensed therethrough and through the nozzle 18. The fluid valve 42 is carried on, or operatively coupled to, a valve stem 44. The bottom of the valve stem 44 is positioned on or operatively coupled to the handle/lever 38 which can be manually raised or actuated by the user. In order to operate the nozzle 18 and dispense fluid, the user can manually raise the lever 38, and when refilling conditions are appropriate, the lever 38 engages and raises the valve stem 44, thereby raising/opening the fluid valve 42, as shown in FIG. 3.

A venturi poppet, poppet valve or suction generator 46 is positioned in the fluid path 21. A venturi poppet spring 48 engages the venturi poppet 46 and urges the venturi poppet 46 to a closed position (FIG. 2) wherein the venturi poppet 46 engages an annular seating ring 50. When fluid of a sufficient pressure is present in the fluid path 21 (i.e., during dispensing operations), the force of the venturi poppet spring 48 is overcome by the pressure of the dispensed fluid and the venturi poppet 46 is moved to its open position, away from the seating ring 50, as shown in FIG. 3.

When the venturi poppet 46 is open and liquid flows between the venturi poppet 46 and the seating ring 50, a venturi effect is created in a plurality of passages 52 extending through the seating ring 50. The passages 52 are, in one case, radially extending, and in fluid communication with a sensing path or suction path 54 formed in the nozzle body 32. The suction path 54 is in turn in fluid communication with a suction chamber 56, of a shut-off valve/device 58. The suction path 54 is in fluid communication with the passages 52 at location 126. Thus the venturi poppet 46 positioned in the fluid path 21 is configured such that when fluid of a sufficient pressure flows through the fluid path 21 the venturi poppet 46 is opened and creates a negative pressure in the suction path 54 by a venturi effect. Suction forces can also be generated in the suction path 54 by any of a variety of other arrangements that can, in some cases, utilize pressure/forces applied by fluid flowing though the nozzle 18, and the suction generator 46 includes such other arrangements.

The suction path 54 includes and/or is in fluid communication with a suction tube 60 positioned within the spout 36. The suction tube 60 terminates at, and is in fluid communication with, an opening or suction tube opening 62 positioned on the underside of the spout 36 at or near the distal end 64 thereof. The suction tube 60, and other portions of the nozzle 18 exposed to the suction/venturi pressure, form or define the suction path 54 which is fluidly isolated or generally fluidly isolated from the fluid path 21.

Figure 13:
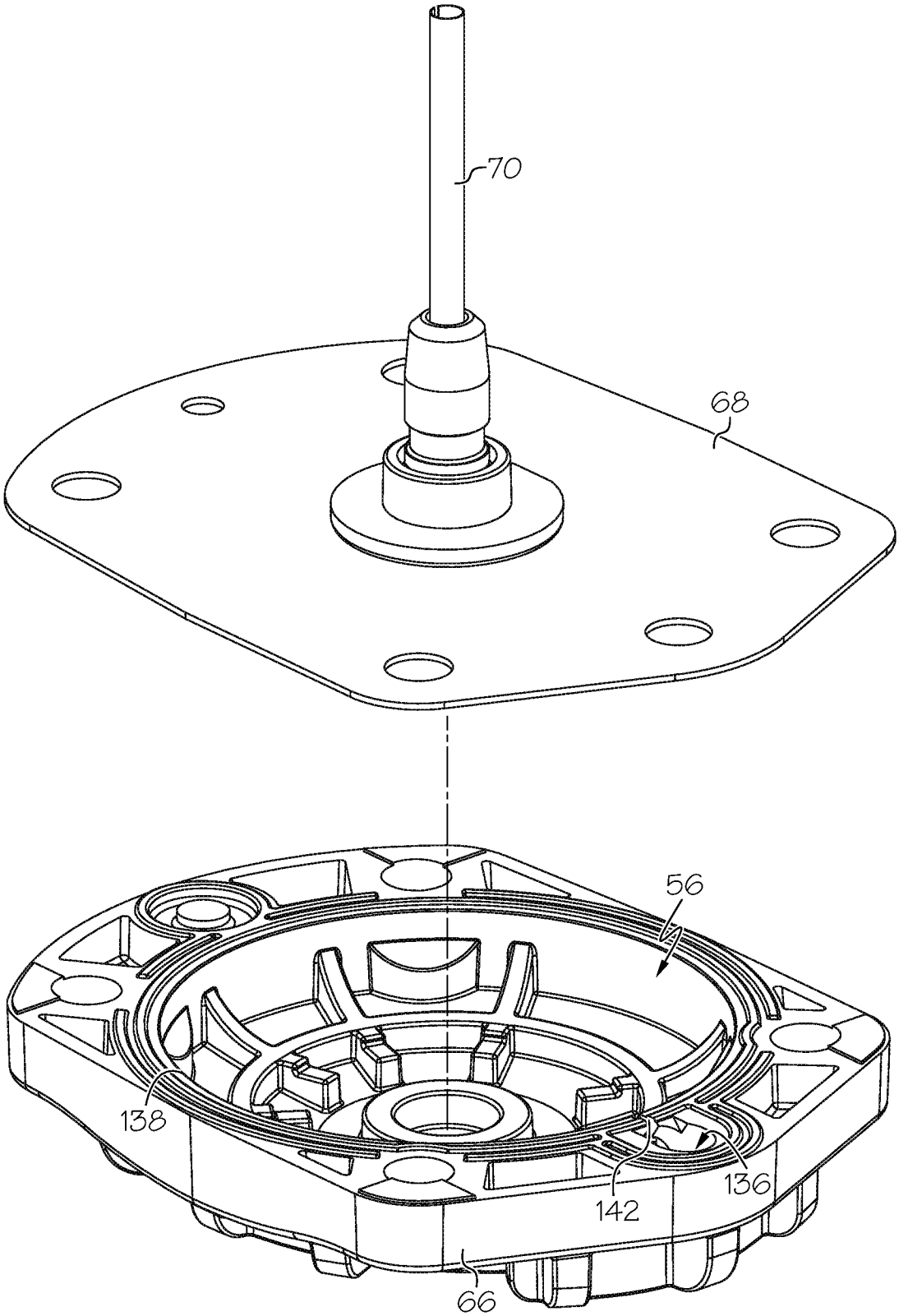
FIG. 13 is another perspective view of the underside of the cap of FIG. 12, with the diaphragm exploded away.

The shut-off device 58 includes a cap 66 and a diaphragm 68 generally defining the suction chamber 56 therebetween. The shut-off device 58 further includes a latch pin 70 coupled to the diaphragm 68 (See FIG. 13 illustrating the latch pin 70 and diaphragm in an inverted position), and the latch pin 70 is received in a latch body 72. When the latch pin 70 is in a lower position, the latch pin 70 and latch body 72 are rigidly coupled together (e.g. by a three-ball coupling arrangement, not shown), and the latch body 72 provides a pivot/lever point about which the lever 38 can pivot. Thus, when the latch pin 70 is lowered the nozzle 18 can be operated to dispense fluid, and the shut-off device 58 is in open or operating configuration. In contrast, when the latch pin 70 is raised, the latch pin 70 is not rigidly coupled relative to the latch body 72. In this case, the latch body 72 does not provide a pivot/lever point about which the lever 38 can pivot, and dispensing operations are prevented or terminated, and the shut-off device 58 is in a closed or non-operating configuration.

When the lever 38 is manually raised and the nozzle 18 is dispensing fluid (e.g. in the configuration shown in FIG. 3), venturi poppet 46 is open and fluid can flow through the fluid path 21. In this case the venturi or negative pressure in the passages 52 and the suction path 54 draws air through the opening 62 and suction tube 60, thereby dissipating the negative pressure. When the opening 62 at the end of the spout 36 is blocked, such as when liquid levels in the tank 30 reach a sufficiently high level that the opening 62 is submerged in liquid, the negative pressure is no longer dissipated, and the negative pressure is applied to the suction chamber 56.

The decrease in pressure in the suction chamber 56 of the shut-off device 58 causes the diaphragm 68 to move upwardly. Since the latch pin 70 is coupled to the diaphragm 68, movement of the diaphragm 68 upwardly caused the latch pin 70 to move upwardly relative the latch body 72. The upward movement of the latch pin 70 releases the rigid connection between the latch pin 70 and the latch body 72, enabling the latch body 72 to move along its axis. Such movement of the latch body 72 along its axis causes the lever 38 to lose its leverage/pivot point, and the lever 38 is lowered, causing the fluid valve 42 to close and stopping dispensing operations. In this manner when the suction path 54 is blocked during fluid dispensing the shut-off device 58 moves to its closed configuration to block or prevent the nozzle 18 from dispensing fluid through the fluid path 21.

Thus the shut-off device 58 utilizes the negative pressure generated by the venturi poppet 46 to provide a shut-off feature which terminates refueling/fluid dispensing when liquid is detected at the tip of the spout 36. Further details relating to these features can be found in U.S. Pat. No. 2,582,195 to Duerr, the entire contents of which are incorporated herein by reference, U.S. Pat. No. 4,453,578 to Wilder, the entire contents of which are hereby incorporated by reference, and U.S. Pat. No. 3,085,600 to Briede, the entire contents of which are incorporated herein.

Two-Part Eccentric Spout

Figure 4:
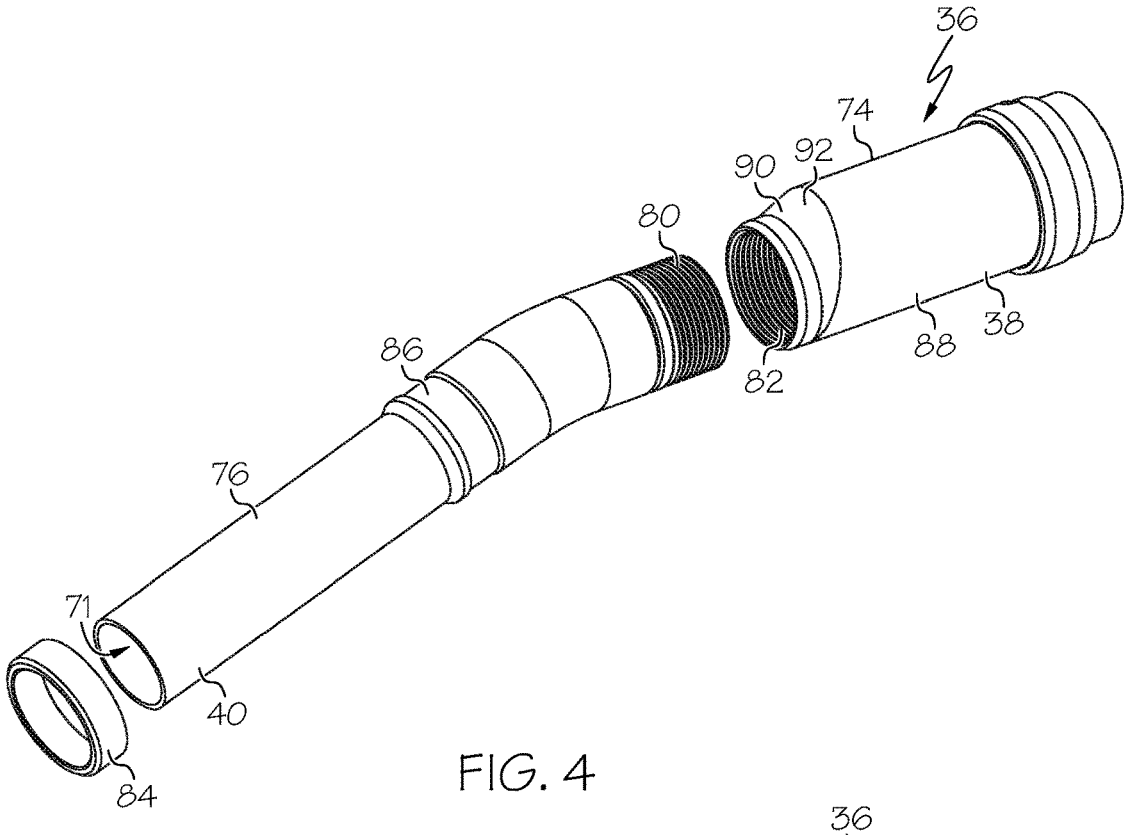
FIG. 4 is an exploded perspective view of the spout of the nozzle of FIGS. 1-3.
Figure 5:
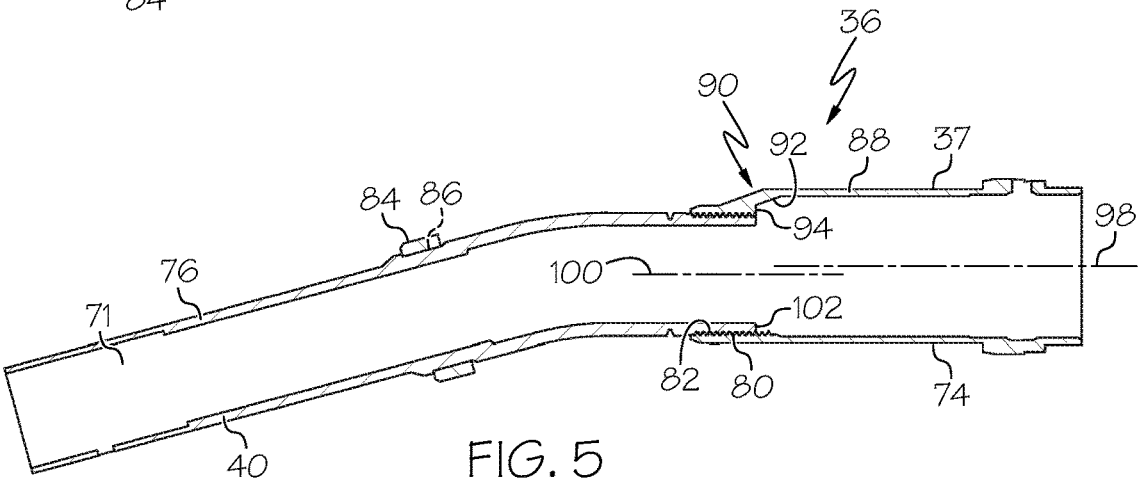
FIG. 5 is a side cross section of the spout of FIG. 4 in an assembled configuration.

FIGS. 4 and 5 illustrate an embodiment of the spout 36 or spout shell 36 which can form the outer-most component of the nozzle 18 along the majority of its distal end. The spout 36 has or defines an inner cavity 71 and can be made of two separate pieces: a first or upstream segment 74, and a second or downstream segment 76. The upstream segment 74 can include the base portion 37 and the downstream segment 76 can include the end portion 40. The upstream 74 and downstream 76 segments may be able to be removably coupled together. For example, the downstream segment 76 can include a threaded upstream male end 80 which is threadably receivable into a threaded downstream female end 82 of the upstream segment. During assembly, the upstream 74 and downstream segments 76 can be secured together, for example using a threadlocking product such as LOCTITE®. An anchoring ring 84 can be received in a groove 86 of the downstream segment 76 and secured in place, such as by crimping.

The upstream segment 74 can have two portions: a fixed portion 88 and a transition portion 90. In the illustrated embodiment the fixed portion 88 has a generally uniform, generally circular (inner and/or outer) cross-section along all or a majority of its length, and the fixed portion 88 can constitute a majority of a length of the upstream segment 74. Similarly, the downstream segment 76 can have a generally uniform, generally circular (inner and/or outer) cross-section along a majority or an entirety of its length thereof. However in some cases rather than being strictly circular, the cross-sections can have a slightly flattened bottom surface.

The downstream segment 76 can have a smaller cross-section area than the cross-section area of the fixed portion 88 of the upstream segment 74. In particular, as will be described in greater detail below, the fixed portion 88 of the upstream segment 74 typically is required to have a larger cross-section area in order to accommodate a spout adapter 91 (FIGS. 6 and 7) and various other components therein, whereas the downstream segment 76 is desired to have a smaller cross-section to fit into a standard fill pipe 26.

The transition portion 90 can be positioned between the fixed portion 88 and the downstream segment 76 along a length of the spout 36 and can have a non-uniform cross-sectional area along its length/axis. In addition, a downstream axial end of the fixed portion 88 can be generally axially aligned with an upstream axial end of the transition portion 90, and an upstream axial end of the downstream segment 76 can be generally axially aligned with a downstream axial end of the transition portion 90. Thus the fixed portion 88 of upstream segment 74 can have a center 98, as shown in FIG. 5, and the adjacent portion of the downstream segment 76 can have a center 100, and the centers 98, 100 are not aligned.

Figure 5A:
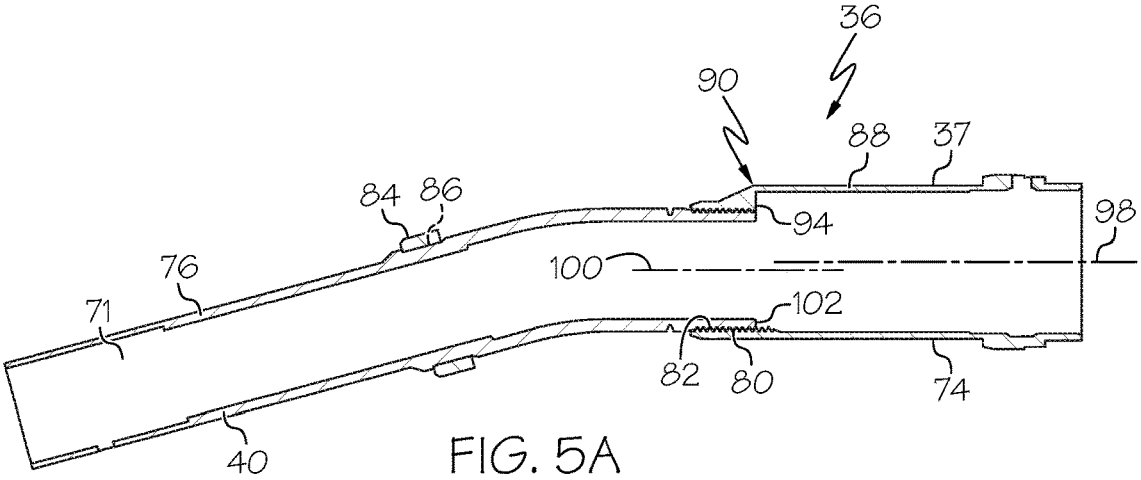
FIG. 5A is an alternate side cross section of the spout of FIG. 4 in an assembled configuration.

The transition portion 90 presents a progressively reduced cross-sectional area moving in the downstream direction along the spout 36 to provide an eccentric shape. In one case, the transition portion 90 can have successive cross-sections that define a variety of substantially circular cross-sectional shapes with successively smaller diameters, moving in the downstream direction with respect to the flow of fluid, where a bottom point of each of the circles are aligned in one case. In this manner the transition portion 90 generally transitions the internal cross-sectional area of the spout 36 from that of the fixed portion 88 of the upstream segment 74 to the downstream segment 76. Furthermore, it should be understood that rather than forming a gradual or angled transition in some cases, the transition portion 90 can include or consist of a step wise change (FIG. 5A).

As outlined above, the inner cavity 71 and/or outer surface of the upstream segment 74 (or at least portions thereof) and the downstream segment 76 (or at least portions thereof) can have a constant cross-section along a length thereof. However, the inner cavity 71 of the transition portion 90 can have a varying cross-section along its length. In particular, with reference to FIG. 5, it can be seen that the transition portion 90 includes a tapered surface 92 along its upper extent, but the bottom, opposite portion/surface remains generally straight. The tapered surface 92 is positioned adjacent to a generally radially-extending lip 94, wherein the lip 94 transitions to and is generally aligned with an upstream axial end of the downstream segment 76.

As will be described in greater detail below, a fluid tube or fuel tube 96 (FIGS. 6-8) can be positioned in the cavity 71 of the spout 36, and fluid flowing through the fluid path 21 in the spout 36 flows through the fuel tube 96. The eccentric positioning of the transition portion 90 ensures that the lower-most portions of the upstream segment 74 and downstream segment 76 remain generally aligned, and the fuel tube 96 lying therein does not present any significant vertical rise to liquid flowing therethrough. In this manner, any liquid flowing through the fuel tube 96 (or through the spout 36) does not need to move upward in any significant manner against the force of gravity when the nozzle 18 is in its dispensing position. This arrangement helps to ensure that all liquid flowing through the spout 36/fuel tube 96 drains freely from the nozzle 18 to reduce pooling and promote self-draining, and that the fuel tube 96 is located in the lowest location of the spout 36.

Figure 7:
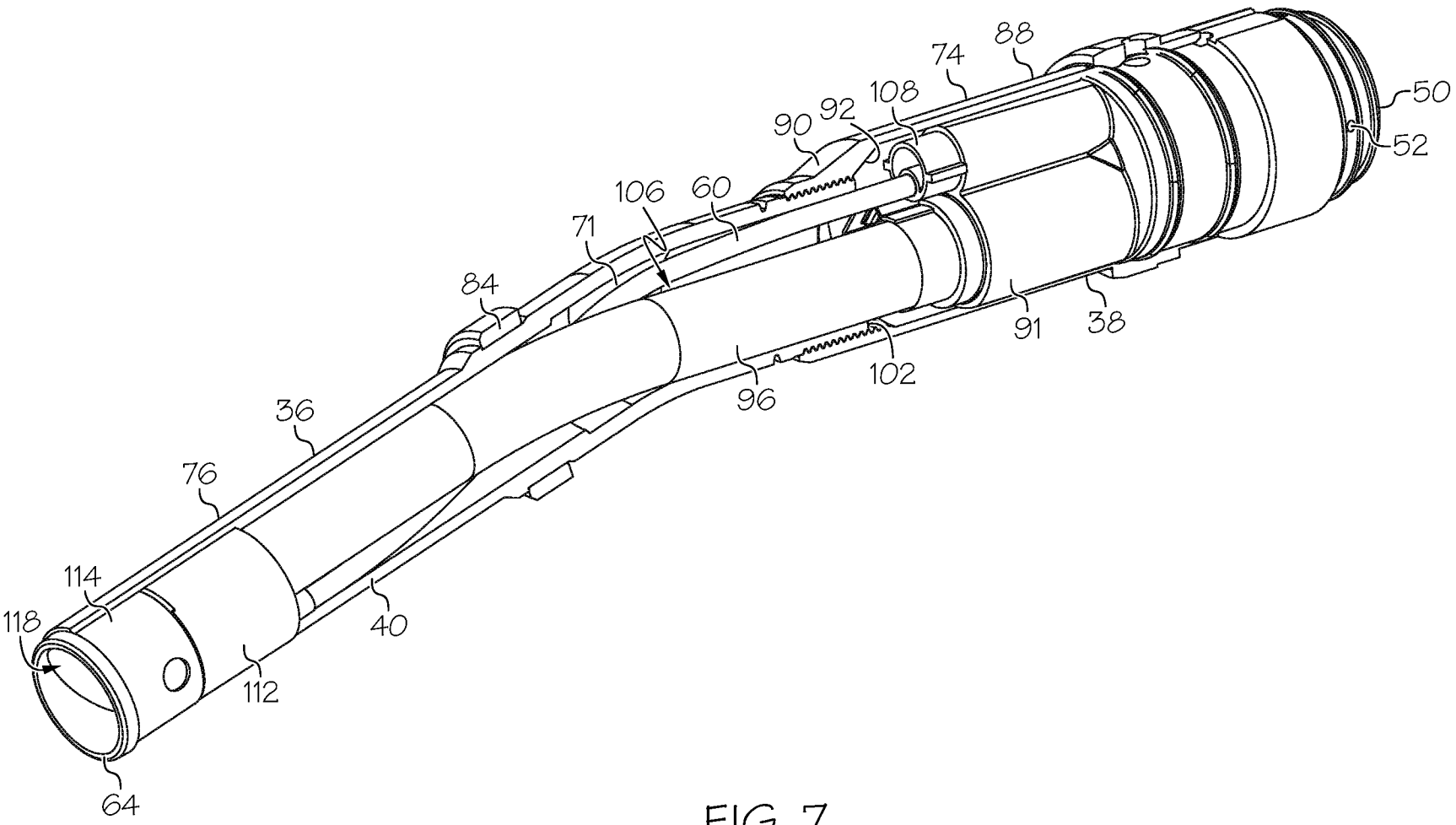
FIG. 7 is a side perspective partial cutaway of the assembled spout subassembly of FIG. 6 in the spout of FIGS. 4 and 5.
Figure 8:
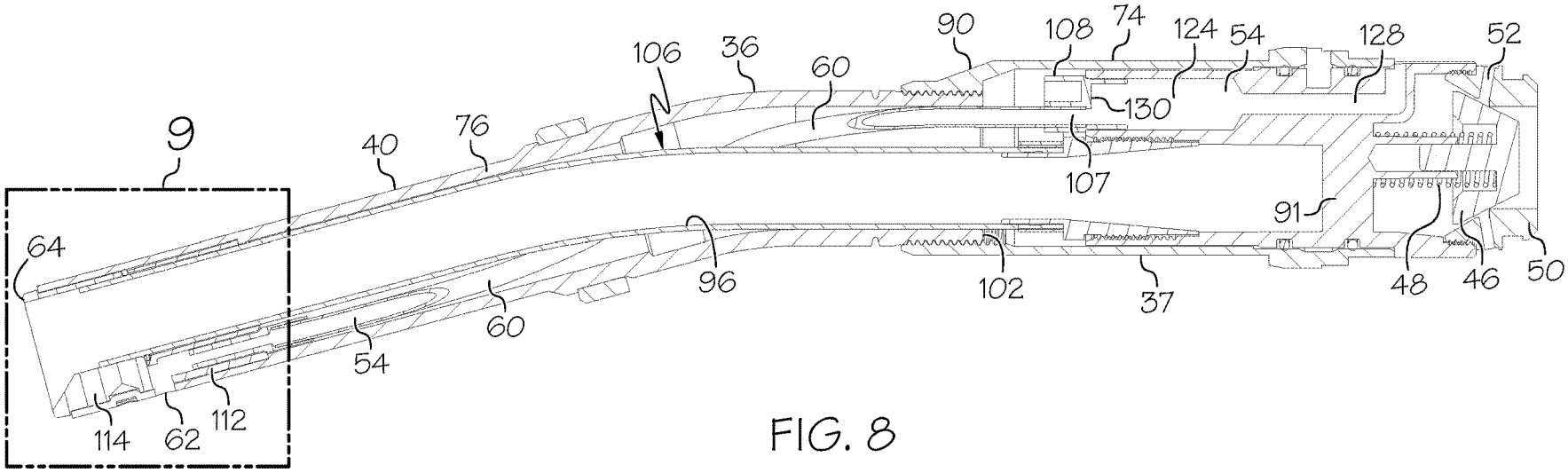
FIG. 8 is a side cross section of the spout and spout subassembly of FIG. 7.

It is noted that the bottom surfaces of the upstream segment 74 and downstream segment 76 may not be exactly aligned at their point of connection, and the spout 36 may instead present slight lip or step 102 defined by the thickness of the threaded inner male end 80 of the downstream segment 76. However, as shown in FIGS. 7 and 8 the fuel tube 96 can be positioned above this lip 102 and retained above the lip 102 due to the stiffness of the fuel tube 96. In addition, the lip 102 is typically quite small (less than about 0.2 inch in one case, and less than about 0.15 inch in another case; and/or less than about 15% of an outer diameter of the spout 36 in one case and/or less than about 10% of an outer diameter of the spout 36 in another case). In this manner, the bottom surface of the upstream segment 74 adjacent to the transition portion 90, and the bottom surface of the downstream segment 76 adjacent to the transition portion 90, along with a bottom surface of the transition portion 90, can all be considered to be generally aligned in a straight line.

The upstream segment 74 (including the fixed portion 88 and the transition portion 90, in the illustrated embodiment) and the downstream segment 76 can have any of a variety of lengths along their axes thereof. In the illustrated embodiment, however, the fixed portion 88 of upstream segment 74 is shorter than the downstream segment 76, and the transition portion 90 is shorter than both the downstream segment 76 and the fixed portion 88 of the upstream segment 74. Thus the fixed portion 88 can have a length at least equal to the length of the transition portion 90, and the downstream segment 76 can have a length at least equal to the length of the transition portion 90.

Some nozzles 18 may utilize a spout 36 made of a single, unitary seamless piece of material. In contrast, the spout 36 disclosed as shown herein is made of two discrete pieces of material: the upstream segment 74 and the downstream segment 76. Breaking the spout 36 into two pieces in this particular manner provides several distinct advantages. First, by using two discrete pieces, ease of machining/manufacturing the spout 36 is significantly increased. For example, the downstream segment 76 can include a constant diameter inner/cross-section along its length, and therefore be relatively easily formed. In addition, the transition portion 90, in the two-piece spout 36, is positioned immediately adjacent an axial end of the upstream segment 74. The transition portion 90 could in other cases be located at a mid-axial position and thus be relatively difficult to manufacture/machine due to its eccentric and/or varying cross-section. However by positioning the transition portion 90 adjacent to an axial end of the segment 74, as in the two-piece spout 36 disclosed herein, greater and immediate access is provided to the transition portion 90 and/or the inner surfaces 92, 94 thereof, providing ease of manufacturing.

In addition, forming the spout 36 of two pieces 74, 76 can enable the spout 36 to be made of two different types of material if desired. For example, one segment 74, 76 can be made of stainless steel, and the other segment 74, 76 made of aluminum. However, in one embodiment both of the segments 74, 76 are made of aluminum.

FIGS. 3 and 4 illustrate the transition portion 90 formed as a single, unitary seamless piece of material with the remainder of the upstream segment 74. However, if desired, the position of the transition portion 90 can be reversed, and the transition portion 90 can instead be formed as a single unitary seamless piece with the downstream segment 76, located at an upstream end thereof Spout Seal With reference to FIGS. 6 and 7, an inner sub-assembly 106 is positioned in the spout 36. The inner sub-assembly 106 can include, generally speaking, the spout adapter 91, a tube adapter 108, a collar 110, the suction tube 60 and the fuel tube 96. The fuel tube 96 and/or suction tube 60 can be semi-flexible and made of a variety of materials, such as PTFE, which is inert with respect to a variety of fuels and fluids and has low surface tension to promote free draining. The venturi poppet 46, seating ring 50 and associated venturi poppet spring 48 are coupled to an upstream end of the spout adapter 91. The tube adapter 108 is threaded into the spout adapter 91 and provides a fluid connection between the fuel tube 96 and the spout adapter 91, and between the suction tube 60 and the suction path 54 in the spout adapter 91. The spout adapter 91 can have an eccentric shape similar to that outlined above for the spout 36 so that any liquid flowing through the spout adapter 91 is located at a lower position thereof. Thus the bottom surface of the fluid cavity of the spout adapter 91, when in the dispensing position, can be generally aligned with the bottom surface of the spout 36/fuel tube 96/tube adapter 108 to ensure liquid flowing therethrough does not flow over any significant vertical rise to avoid fluid traps.

Figure 9:
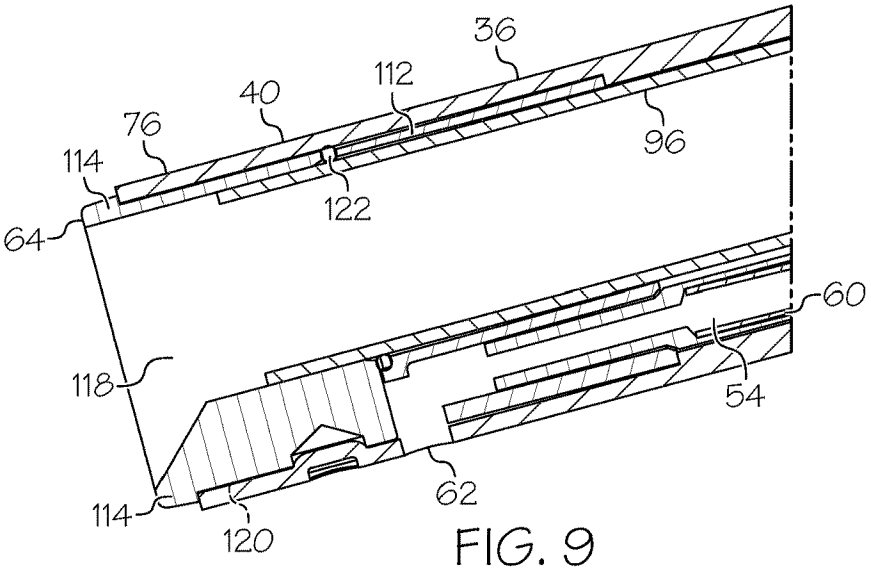
FIG. 9 is a detail view of the area indicated in FIG. 8.

A distal end of the inner sub-assembly 106/spout 36/nozzle 18 includes a tube spacer 112 and a spout tip 114 which forms the distal-most component of the nozzle 18/spout 36. The tube spacer 112 receives a distal end of the suction tube 60 therein, and provides/forms at least part of the opening 62 on the underside of the spout 36, as shown in FIGS. 8 and 9. The tube spacer 112 and spout tip 114 are each hollow and include/define an inner opening 118 which defines and/or is part of the fluid path 21, and which are in fluid communication with or receive the fuel tube 96 such that fluid can flow therethrough. Each of the inner openings 118 can be generally circular in cross section, and as shown in FIG. 9 the inner openings 118 can be aligned with each other. In addition, the centers of the inner openings 118 of the tube spacer 112 and spout tip 114 can be offset from the center of the inner cavity 71 of the spout 36. In particular, the tube spacer 112 and spout tip 114 can be raised above the center of the inner cavity 71 of the spout 36 to accommodate the positioning of the suction tube 60 in a lower portion of the spout 36.

With reference to FIG. 9, the spout tip 114 can be generally radially and axially positioned in the spout 36, but a distal end 64 of the spout tip 114 can extend axially beyond the spout 36 to act as a protective/sacrificial component, such as when the nozzle 18 is dropped onto the ground. The spout tip 114 thus can be made of a relatively hard, durable material such as stainless steel. The spout tip 114 can include an annular groove 120 on its outer surface which receives a distal end of the spout shell 36 therein to help secure the spout tip 114 in place.

Figure 6:
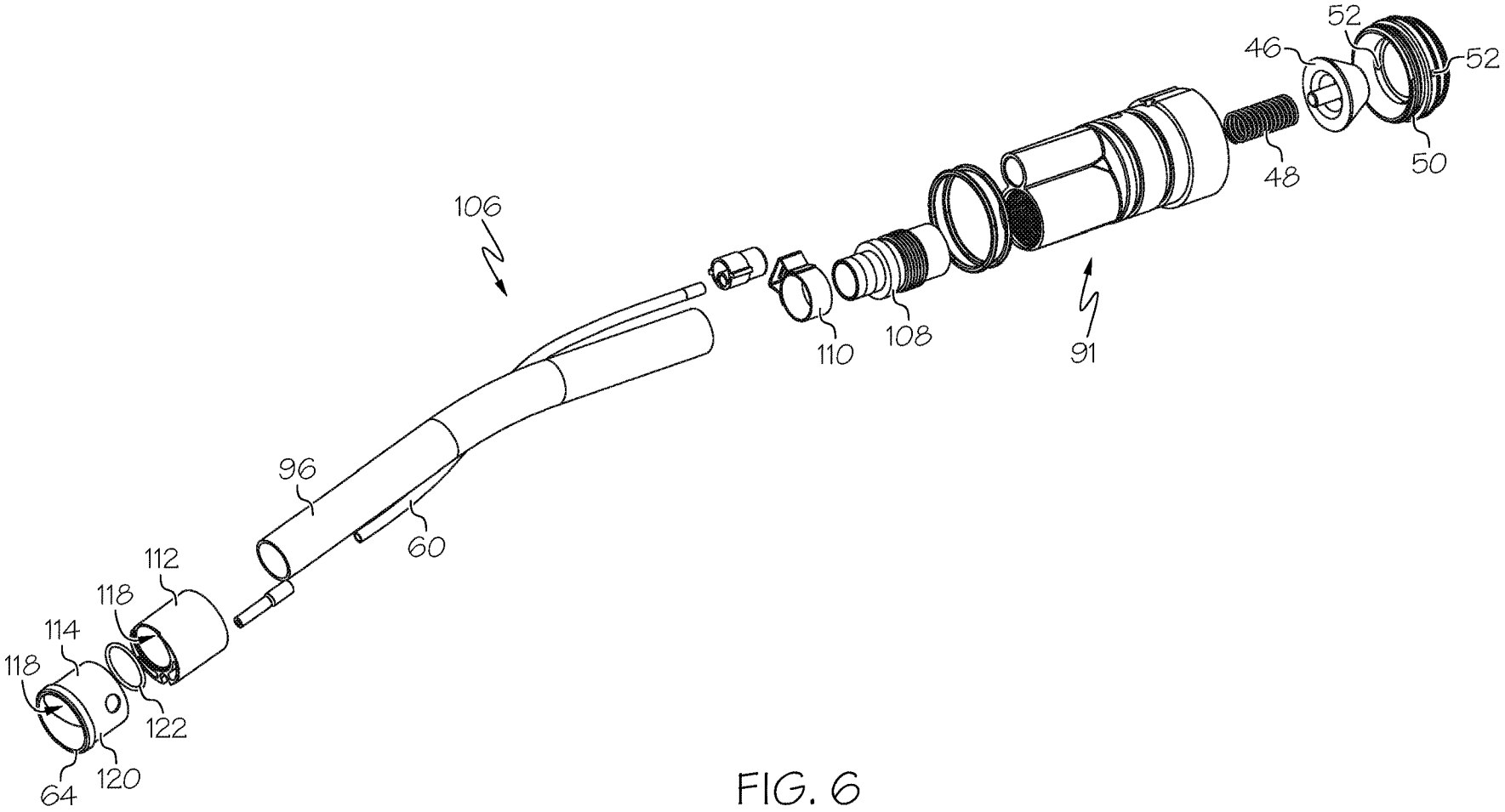
FIG. 6 is an exploded perspective view of a spout subassembly positionable inside the spout of FIGS. 4 and 5.

As best shown in FIGS. 6 and 9, a spout seal 122, such an O-ring, can be positioned axially between the spout tip 114 and the tube spacer 112. The O-ring 122 extends around the fluid path 21 in each of the spout tip 114 and tube spacer 112, and also sealingly engages the inner surface of the spout 36. Thus the seal 122 extends entirely circumferentially around both inner openings 118 and engages adjacent axial end surfaces of the spout tip 114 and tube spacer 112. In this manner the seal 122 provides a seal between the spout tip 114 and tube spacer 112 and also seals the interstitial space between the spout tip 114/tube spacer 112/fuel tube 96 and the spout 36. The seal 122 thus engages three components and prevents any fluid that can happen to work itself into the interstitial space between the spout 36 and the spout tip 114/tube spacer 112/fuel tube 96 (such as when the spout 36 is submerged in fluid) from traveling upstream away from the distal end 64, which in turn reduces dripping from the nozzle 18. The fluid tube 96, the tube spacer 112 and the seal 122 can all positioned radially and axially inside the spout 36. The seal 122 can be located at or near a distal end 64 of the nozzle 18/spout 36; e.g. in one case located no more than 10% of a length of the spout 36 from the distal end 64 of the nozzle 18/spout 36, to minimize fluid present in the interstitial space.

Expansion Chamber

With reference to FIG. 8, the suction path 54 may include an expansion chamber 124 therein, which can be positioned in and/or form part of the suction path 54. The suction tube 60 may be secured to the tube adapter 108, wherein the tube adapter 108 includes an opening 107 formed therein which is fluidly connected to the expansion chamber 124. Thus in the illustrated embodiment the expansion chamber 124 is positioned just downstream of the downstream end of the suction tube 60 (with respect to the flow of fluid through the suction path 54).

The expansion chamber 124 provides an area of increased cross sectional area so that fluid flowing into the expansion chamber 124 experiences a decrease in velocity. In this manner the expansion chamber 124 enables any liquid, such a fuel, that is entrained in the flow of fluid in the suction path 54 to collect in the expansion chamber 124 and not be transported any further upstream. Once dispensing operations are ceased and/or fluid flow through the suction path 54 is stopped, any liquid in the expansion chamber 124 can quickly drain back down the suction tube 60 into the vessel being refueled where it originated from.

With reference to FIGS. 2, and 3, as noted above the radially extending passage or passages 52 associated with the venturi poppet 46/suction generator intersects the suction path 54 at position 126. Thus suction is applied to the suction path 54 at position 126, and in the illustrated embodiment the expansion chamber 124 is positioned upstream (with respect to the flow of fluid through the suction path 54) of the venturi poppet 46 and/or shut-off device 58 and/or position 126 to seek to avoid any entrained liquid entering the poppet 46 and shut-off device 58. The positioning of the expansion chamber 124 also ensures the expansion chamber 124 is located relatively close to the opening 62 to provide quick draining.

In one case the suction tube 60/opening 107 and/or the portion 128 of the suction path 54 located immediately downstream of the expansion chamber 124 each have a fixed, circular cross section along a majority of their lengths, or at least for those portions adjacent to the expansion chamber 124. The suction tube 60 can have a length greater than the expansion chamber 124, and the opening 107 can have a length less than the expansion chamber 124. The expansion chamber 124 can also have a fixed, circular cross section along a majority of its length. In addition as outlined above the expansion chamber 124 can have a greater cross sectional area than a portion of the suction path 54 positioned immediately upstream of the expansion chamber so that the fluid experiences a decrease in speed when entering the expansion chamber 124. In addition, in the illustrated embodiment the expansion chamber 124 is defined by an upstream wall 130 positioned generally perpendicular to the flow of fluid through the suction path 54 (i.e. generally oriented in a radial plane) so that a cross sectional area of the suction path 54 increases in a stepwise manner when entering the chamber 124.

The amount of increase in cross sectional area between the expansion chamber 124 and the opening 107 and/or suction tube 60 located immediately upstream of the expansion chamber 124 can vary as desired. In one case however the expansion chamber 124 has a cross sectional area of at least about double than a portion of the suction path 54 positioned immediately upstream of the expansion chamber 124, and in another case at least about ten times greater in order to provide the sufficient desired velocity drop to enable entrained liquid to collect in the expansion chamber 124. In another case the expansion chamber 124 has a cross sectional area of at least about 0.050 square inches, and in another case at least about 0.075 square inches.

As can be seen, at a downstream end of the expansion chamber 124, the suction path 54 decreases in cross sectional area at portion 128. Thus in the illustrated embodiment the expansion chamber 124 has a greater cross sectional area than portions of the suction path 54 positioned both immediately upstream of the expansion chamber 124 and positioned immediately downstream of the expansion chamber 124.

The expansion chamber 124 and the portions of the suction path 54 located immediately upstream of the expansion chamber can be arranged such that their bottom surfaces (when the nozzle 18 is in its dispensing position) are generally aligned in a straight line to promote free draining of liquid in the same or similar manner as described above in the "Two-Part Eccentric Spout" section. In this manner, any flowing liquid exiting the expansion chamber 124 and flowing through the suction path 54 does not need to move upward against the force of gravity when the nozzle 18 is in its dispensing position in order to flow through the suction path 54. In one case then, the expansion chamber 124 and a portion of the suction path 54 positioned immediately upstream of the expansion chamber each have a center, and the centers are offset and not aligned, while the bottom surfaces are aligned. The other various features described above in the context of the "Two-Part Eccentric Spout" are equally applicable to the expansion chamber 124 and adjacent areas, and are not repeated here, but provide the same or similar benefits.

As shown in FIGS. 6 and 7 the suction tube 60 can be at least partially wrapped around the fuel tube 96 in a circumferential direction, and the tube 60 can be sufficiently flexible to assume the "spiral" configuration shown in FIGS. 6 and 7, even when the tube 60 is initially formed as a straight tube. This configuration ensures that all portions of the suction tube 60 are angled downwardly when the nozzle 18 is in the dispensing position to ensure free draining of any liquid in the suction tube 60 out of the suction path 54.

Self-Venting Suction Path

With reference to FIGS. 2 and 3 (and also FIGS. 10 and 11), the suction path 54 may include a terminal portion 132 which can be positioned just upstream of the suction chamber 56 of the shut-off device 58. The terminal portion 132 can be positioned downstream the expansion chamber 124 and also of the position 126 where suction is applied to the suction path 54, and/or downstream of the venturi poppet 46. Any liquid in the suction path 54 which happens to make it past the expansion chamber 124 may be sucked into a radially extending passage 52 and be reintroduced into the fluid path 21. In some cases, however, some liquid can extend past both the expansion chamber 124 and the radially extending passages 52 and be present in the terminal portion 132. The terminal portion 132 can be positioned immediately upstream of, and/or terminate in, the shut-off device 58, and more particularly the suction chamber 56 or the shut-off device 58.

One potential concern with liquid positioned in the terminal portion 132 is that the downstream end of the terminal portion 132 is in fluid communication with the suction chamber 56 of the shut-off device 58, which is sealed/closed. Thus the terminal portion 132 is deadheaded, and liquid present in the terminal portion 132 which entirely fills/spans a cross section of the terminal portion 132 (i.e. due to capillary forces or the like) can remain in the terminal portion 132 at least in the short term, and then drain later at an undesirable time.

Accordingly the terminal portion 132 in the current nozzle 18 can be sized and configured to prevent any liquid positioned in the terminal portion 132 from spanning a cross sectional area of the terminal portion 132, which thereby promotes venting and free draining of the liquid from the terminal portion 132. Such drained liquid can then escape via the radially extending passages 52 and/or the opening 62.

In one case then terminal portion 132 is sized to allow gasoline (such as unleaded gasoline having an octane rating of between about 87 and about 95 commonly available from refilling stations) or other liquid to be dispensed, to freely drain out of the terminal portion 132 when the terminal portion 132 is positioned vertically at an ambient pressure of about 1 atmosphere and an ambient temperature of about 70 degrees Fahrenheit, when the terminal portion communicates with a sealed chamber (e.g. the suction chamber 56) at its upstream end. In one case the walls of the terminal portion are made of stainless steel. In this case then the terminal portion 132 is sized to be sufficiently large to prevent capillary forces of liquid gasoline (or other liquid to be dispensed) from enabling the gasoline to completely span a cross sectional area of the terminal portion 132, to thereby enable the terminal portion 132 to be self-venting.

In one case the terminal portion 132 has a cross sectional area of at least about 0.015 square inches in one case, or at least about 0.02 square inches in another case, or at least about 0.03 square inches in yet another case, and has a volume of at least about 0.015 cubic inches in one case, or at least about 0.025 cubic inches in another case. In one case the terminal portion 132 of the suction path 54 has a cross sectional area at least about double, or in another case at least about 5 times greater, than a cross sectional area of the suction path 54 positioned immediately upstream (with respect to a fluid of fluid in the suction path) of the terminal portion 132. The cross sectional area of the suction path 54, from a position immediately upstream of the terminal portion 132, can increase at the terminal portion 132 in a step-wise manner as described above in the context of the expansion chamber 124, or increase gradually. The terminal portion 132 can have a fixed or variable cross section along its length, but in one embodiment has a cross section at least as large as the dimension(s) above, and/or sufficiently large to satisfy the qualitative description above, at all portions along its length. Alternatively, or in addition, the terminal portion 132 can be made of materials and/or have a coating applied thereto which has a low surface tension and/or reduces capillary forces of liquid so that liquids more easily drain and the suction path 54/terminal portion 132 remains self-venting.

Self-Draining Vacuum Shut-Off Cap

Figure 10:
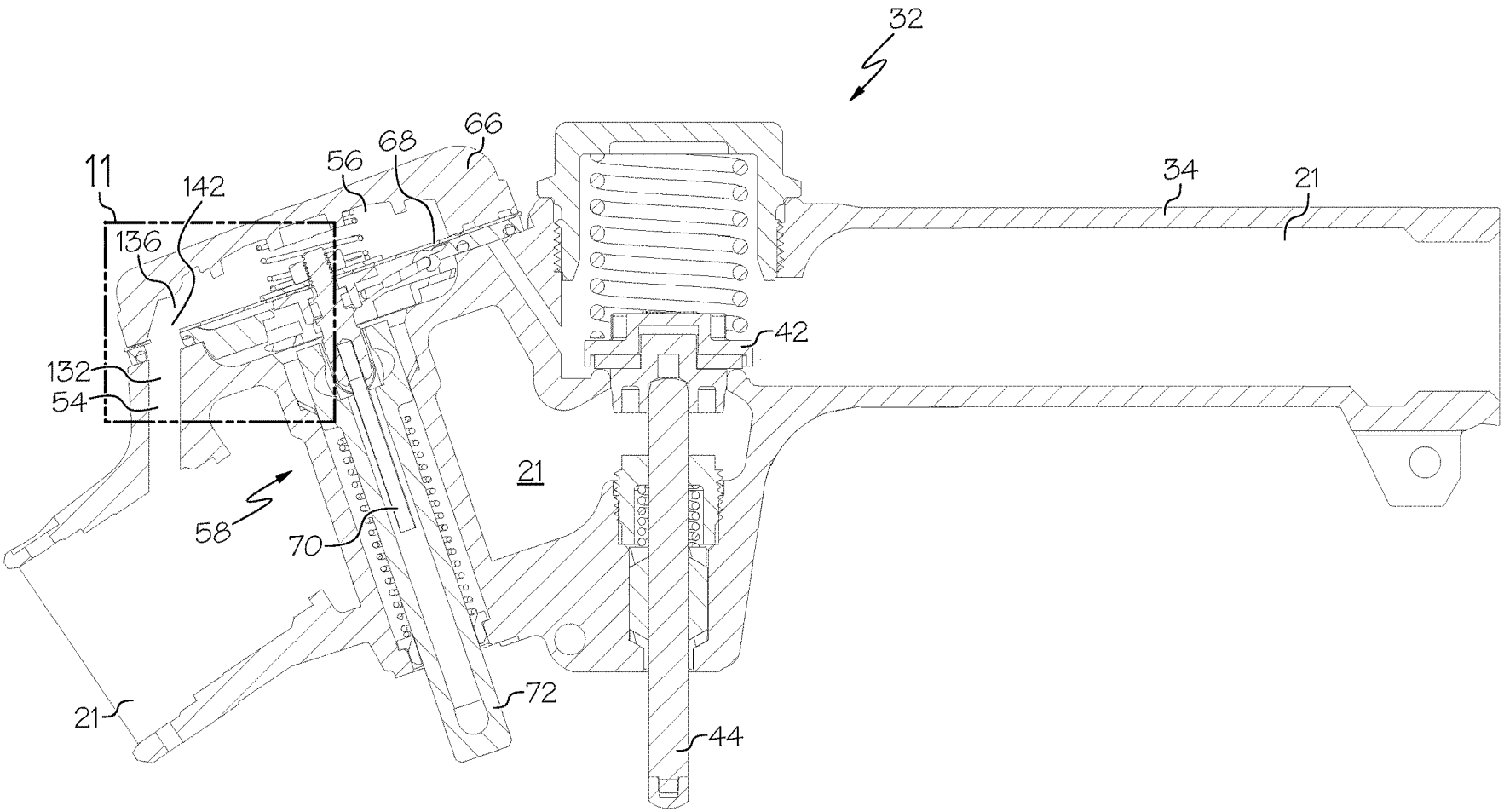
FIG. 10 is a side cross section of the nozzle body of the nozzle of FIG. 2.

As outlined above, and with reference to FIG. 10, the shut-off device 58 can have a suction chamber 56 in fluid communication with the suction path 54. The shut-off device 58 and suction chamber 56 are sensitive to a negative/suction pressure. When the nozzle 18 is dispensing fluid, the venturi poppet 46/suction generator creates a negative pressure in the suction path 54 which is dissipated through the opening 62 via the suction tube 60, during normal operating conditions. When the opening 62 is covered (e.g. by liquid in a fuel tank), the full force of the negative pressure is applied to the suction chamber 56, which causes the diaphragm 68 to move and the shut-off device 58 to move to its closed position, terminating dispensing operations as outlined above.

Figure 11:
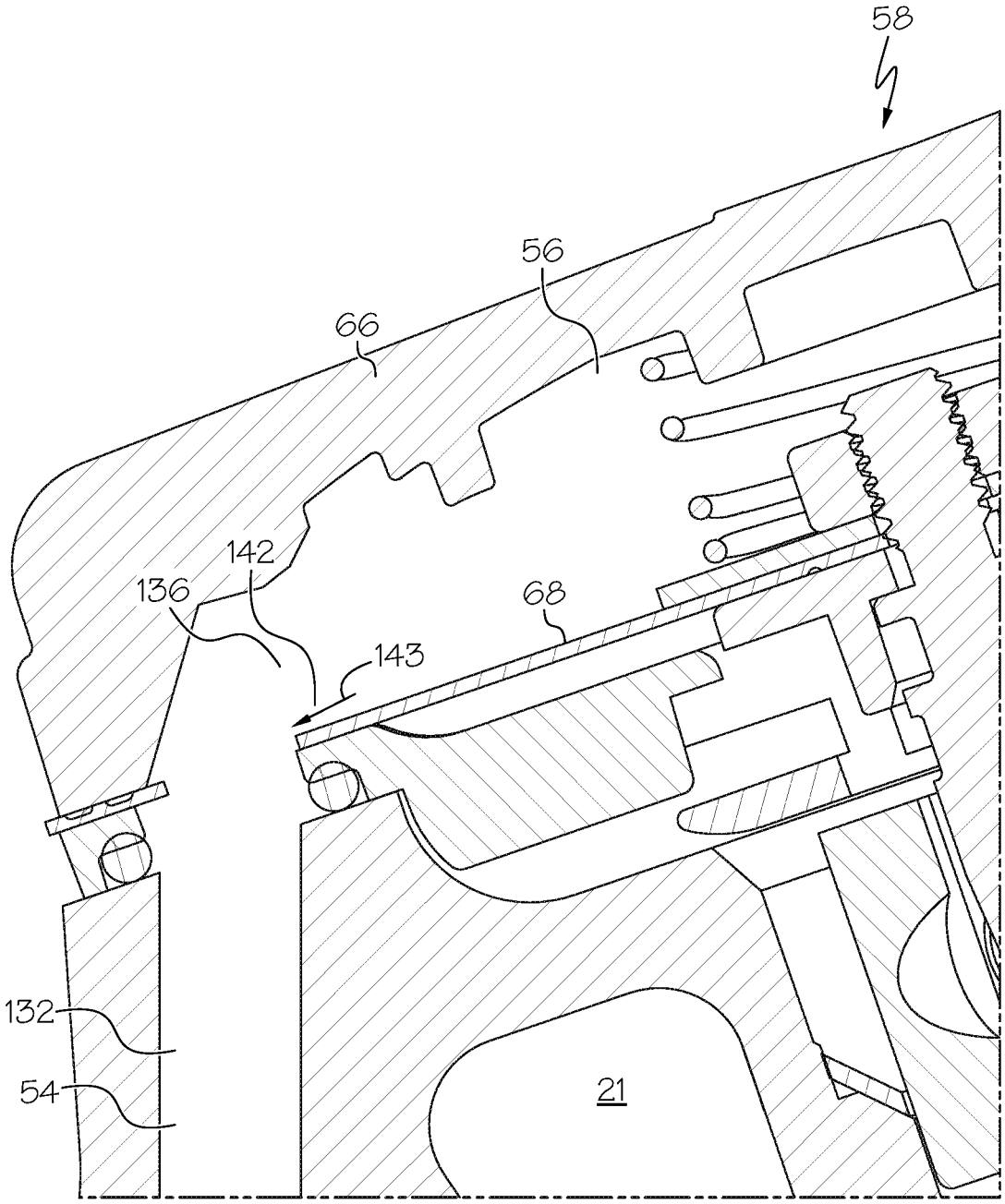
FIG. 11 is a detail view of the area indicated in FIG. 10.
Figure 12:
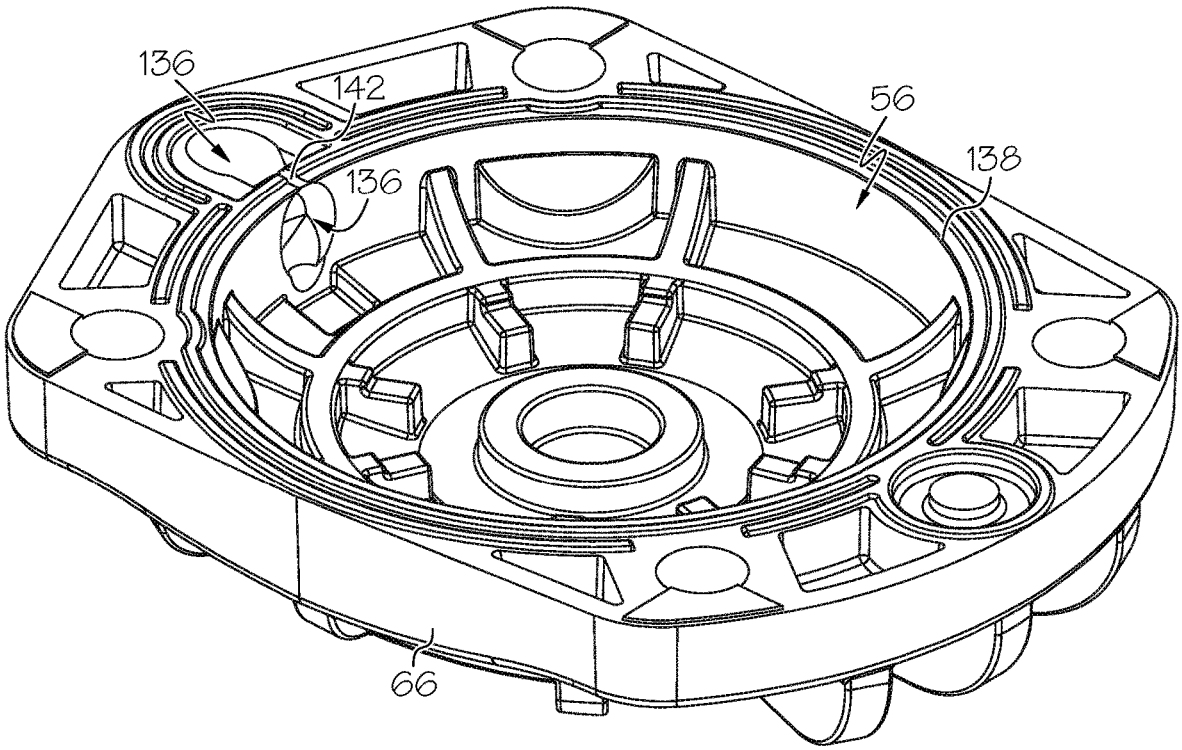
FIG. 12 is a perspective view of the underside of the cap of the nozzle body of FIGS. 10 and 11.

The cap 66, which forms the upper portion of the suction chamber 56, is shown in FIGS. 12 and 13, along with a diaphragm 68 and latch pin 70 shown in FIG. 13 in exploded configuration. It should be understood that FIGS. 12 and 13 illustrate the cap 66 and diaphragm 68 in an inverted configuration from the normal operating configuration for illustrative purposes. During normal operating/dispensing conditions, as shown in FIGS. 10 and 11 the suction chamber 56 is positioned between the diaphragm 68 and the cap 66, and the cap 66 is positioned generally vertically above the diaphragm 68.

With reference to FIGS. 12 and 13, the cap 66 includes a cap opening or supplemental opening 136 formed therethrough which can define and/or be part of the suction path 54. In particular the upstream portion of the cap opening 136 can be in direct fluid communication with and/or form part of the terminal portion 132 of the suction path 54, described above. The downstream portion of the cap opening 136 terminates at the suction chamber 56. In one case the cap 66 is formed as a single, unitary seamless structure which at least partially defines the suction chamber 56, defines a distal end of the fluid path 21, and defines the cap opening 136 formed in one case as a hole, bore or the like in the cap 66.

Figure 14:
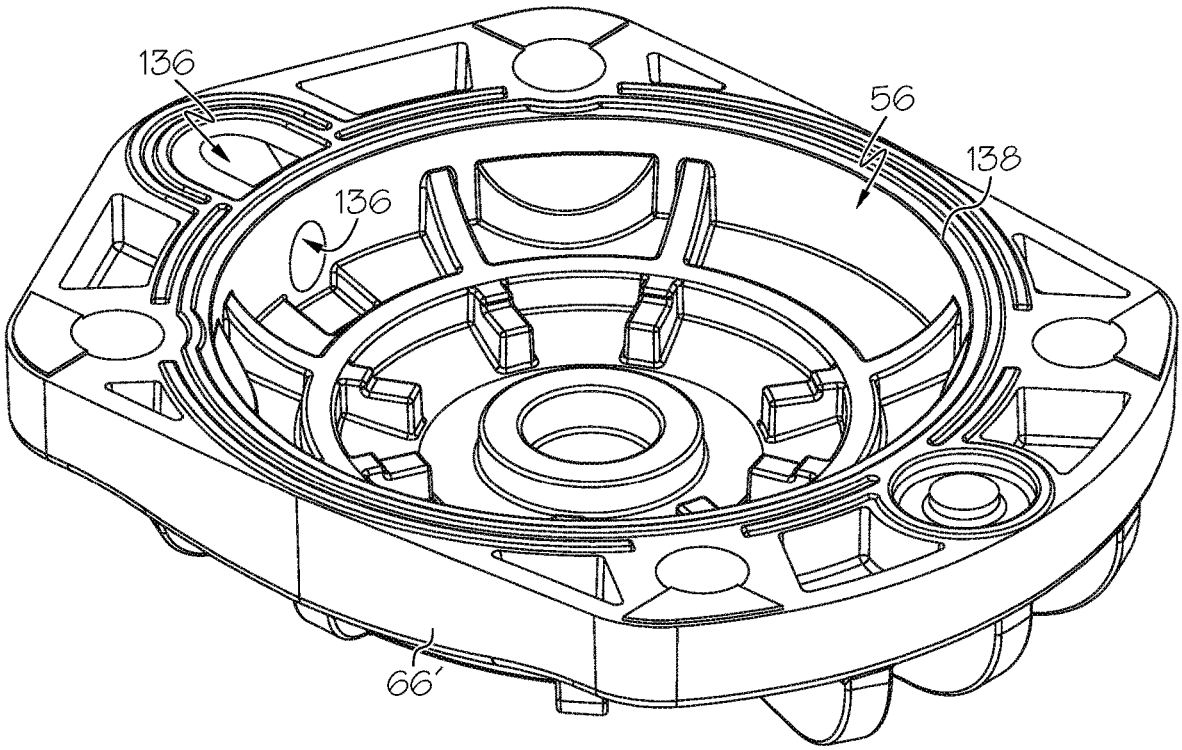
FIG. 14 is a perspective view of the underside of a cap lacking an opening which promotes draining therefrom.
Figure 15:
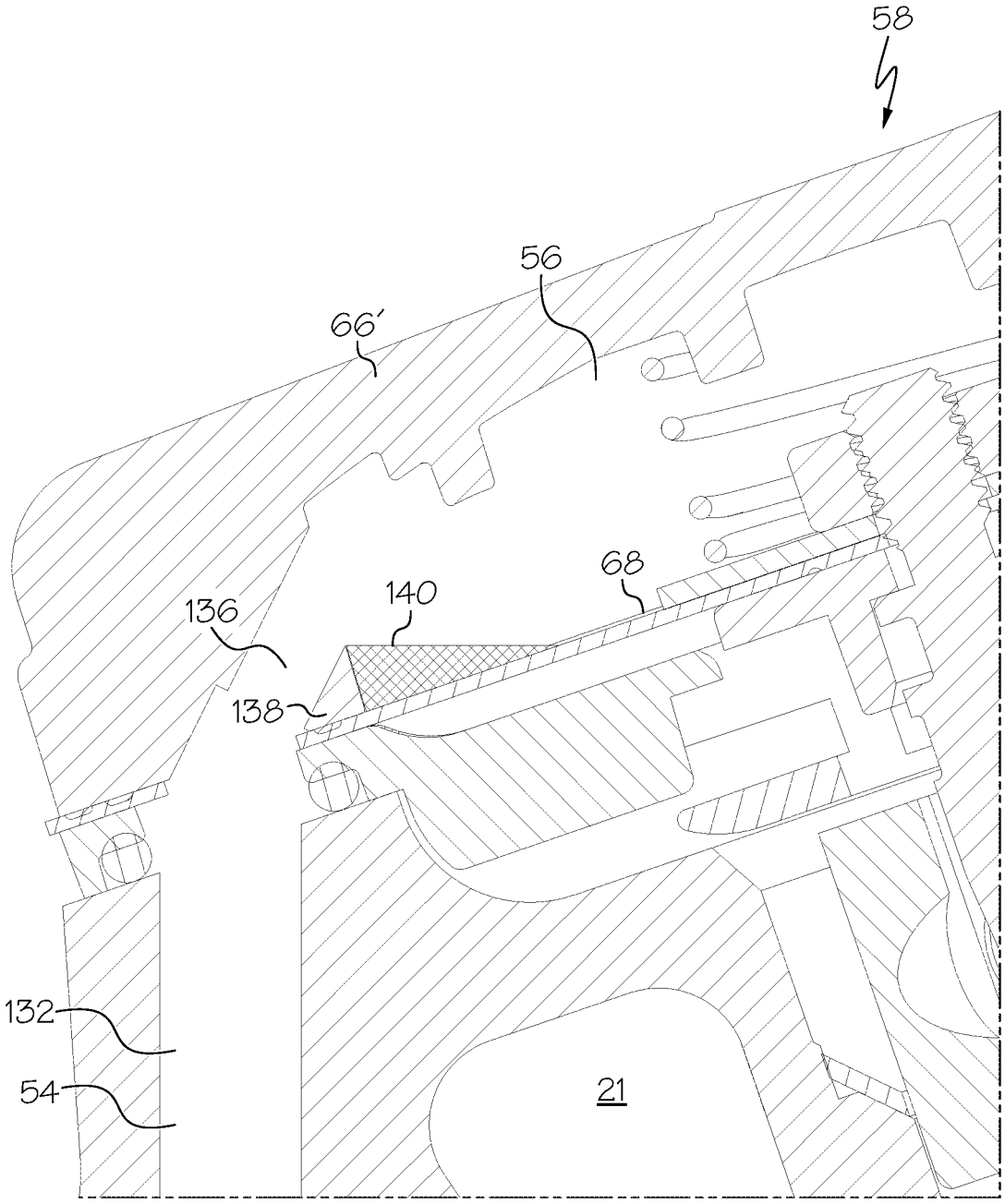
FIG. 15 is a side cross section of a nozzle body of FIG. 11 utilizing the cap of FIG. 14, illustrating how the cap can trap fluid.

The cap 66 can include a lip 138 extending thereabout, and the lip 138 is configured to sealingly engage the diaphragm 68 to form the generally sealed suction chamber 56 therebetween. In some cases the lip 138 may be raised, although the lip 138 can simply be a radially inner edge of the cap 66 and/or a radially outer edge of the suction chamber 56. As shown in FIG. 14, in some existing caps, such as cap 66' the lip 138 extends continuously 360 degrees about the cap 66/diaphragm 68. In this case, as shown in FIG. 15, when the nozzle is in its dispensing position the opening 136 extends up past and over the lip 138 before reaching the suction chamber 56. However, a drawback with such an arrangement is that any liquid in the suction chamber 56 can be trapped behind/adjacent to the lip 138 (shown as trapped liquid 140 in FIG. 15), even when the nozzle 18 is in the dispensing position.

As shown in FIGS. 11-13, in the illustrated embodiment an opening or slit 142 (collectively termed an opening 142 herein) is formed in/through the lip 138 and extends through the lip 138 such that the opening 142 fluidly communicates with the cap opening 136 and the suction chamber 56. In this case the lip 138 extends 360 degrees about the cap 66/suction chamber 56, except for where the opening 142 is located (e.g., at least about 359 degrees in one case, or at least about 350 degrees in one case). Similarly the diaphragm 68 sealingly engages the lip 138 about an entire perimeter of the lip 138, except where the opening 142 is located, such that the suction chamber 56 is generally sealed.

The opening 142 thus provides fluid communication between the suction chamber 56 and the suction path 54 to enable liquid to freely flow from the suction chamber 56 to the suction path 54. FIGS. 10 and 11 are cross sections taken along the opening 142 of FIGS. 12 and 13, and as can be seen in comparison to FIG. 15, the opening 142 removes a portion of the lip 138 adjacent to the suction path 54 so that any liquid in the suction chamber 56 can drain freely from the suction chamber 56 into the suction path 54 (shown via arrow 143 of FIG. 11), and exit the suction path 54 via the radially extending passages 52 and/or opening 62. Thus the opening 142 provides yet another drain feature in case any liquid happens to get past the expansion chamber 124 and happens to get past the terminal portion 132 of suction path 54, and reaches the suction chamber 56. The nozzle 18/cap 66 can be configured such that when the nozzle 18 is in the dispensing position, as shown in FIGS. 10 and 11, any fluid in the suction chamber 56 can flow directly from a lowermost portion of the suction chamber 56 to the suction path 54 to enable liquid to drain from the suction chamber 56.

As outlined above, the suction chamber 56 needs to remain generally/sufficiently sealed so that the diaphragm 68 can move when a low pressure is present in the suction chamber 56 so that the shut-off device 58 remains functional. Thus the opening 142 should be sized to allow sufficient draining of liquid from the suction chamber 56, while ensuring the suction chamber 56 remains sufficiently sealed and the shut-off device 58 retains the desired sensitivity. In one case the opening 142 has a uniform cross-sectional area and has a cross-sectional area, or average cross-sectional area, of less than about 25% of a cross-sectional area or average cross-sectional area of the cap opening 136 and/or the terminal portion 132 of the suction path 54. In an alternative embodiment the opening 142 has a length (extending in the circumferential direction), intersecting the suction chamber and/or the lip 138, of at least about 0.020 inches in one case, or at least about 0.030 inches in one case, and less than about 0.05 inches in one case, or less than about 1% of a circumference/perimeter of the chamber 56. In one case the opening 142 has a cross sectional area of less than about 0.0001 inches and/or less than 1% of an effective surface area of one side of the diaphragm 68. It has been found that a cap 66 with a slit/opening of these dimensions can provide a sufficiently sealed suction chamber 56 to provide an operative shut-off device 58 while still providing sufficient draining of any liquid from the suction chamber 56.

It should also be noted that FIGS. 2, 3 and 10-15 disclose the cap 66 in the form of a so-called "A-cap" which is relatively low-profile and does not accommodate a no-pressure no-flow valve. However, the opening 142 can be utilized in conjunction with a so-called "B-cap" which is deeper and sized to accommodate a no-pressure no-flow valve, should the nozzle 18 utilize such a no-pressure no-flow valve. The opening 142 can also be used in connection with any other caps or similar/analogous components.

SUMMARY

Thus, as can be seen the two-part eccentric spout 36, spout seal 122, expansion chamber 124, self-venting suction path 132 and self-draining vacuum shut-off cap 66 all help to reduce the retention of liquid in the nozzle 18, promote free draining of liquid, and ultimately reduce dripping. Thus these features help to reduce wasted fuel/fluid and provide a more environmentally-friendly nozzle 18. However, while these features work well together, it should be understood that a nozzle 18 need not necessarily include all the features described herein, and instead the features can be used alone or in various combinations together, providing the various benefits described herein.

Having described the invention in detail and by reference to certain embodiments thereof, it will be apparent that modifications and variations are possible without departing from the scope of the invention which is defined in the appended claims.

What is claimed is:

1. A fluid dispensing nozzle system comprising:
a nozzle body including a fluid path therein;
a fluid valve positioned in said fluid path and configured to selectively prevent or allow a flow of fluid through said fluid path;
a manually operable actuator operatively connectable to said fluid valve; and
a spout coupled to said nozzle body and having a cavity to allow fluid flowing through said fluid path to pass through said spout, said spout including a first segment having a first cross sectional area at at least a portion thereof and a second segment having a second cross sectional area at at least a portion thereof that is different than said first cross sectional area, and wherein said first segment has transition portion which asymmetrically transitions along a length thereof from said first cross sectional area at one end thereof to said second cross sectional area at a second opposite end thereof, wherein said first segment is made of a separate piece of material than said second segment.

2. The system of claim 1 wherein said first segment is a single unitary seamless piece of material, and wherein said second segment is a single unitary seamless piece of material.

3. The system of claim 1 wherein said first and second segments are removably attachable together.

4. The system of claim 1 wherein the first and second segments are threadably attachable together.

5. The system of claim 1 wherein said first segment and said second segment are made of differing materials.

6. The system of claim 1 wherein said first segment and said second segment are made of the same material.

7. The system of claim 1 wherein said first segment is positioned upstream relative to said second segment relative to a direction of flow of fluid through said nozzle, and wherein said first cross sectional area is greater than said second cross sectional area.

8. The system of claim 1 wherein said transition portion has a length extending axially along said spout, and wherein said first segment has said first cross sectional area for a length at least equal to at least said length of said transition portion, and wherein said second segment has said second cross sectional area for a length at least equal to at least said length of said transition portion.

9. The system of claim 1 wherein said second segment has said second cross sectional area along generally an entire length thereof, and wherein an end portion of said second segment is angled downwardly relative to a base portion of said nozzle when the nozzle is in a dispensing configuration in which the first segment is horizontally oriented.

10. The system of claim 1 wherein said transition portion, said first segment at locations other than said transition portion, and said second segment each have a generally circular inner cross section at said at least a portion thereof.

11. The system of claim 1 wherein a bottom of inner cross sections of the first segment, the transition portion, and at least part of the second segment are generally aligned.

12. The system of claim 1 wherein said first segment and said second segment, at locations adjacent to said transition portion, each have a geometric center, and wherein said centers are not aligned.

13. The system of claim 1 wherein said transition portion includes a tapered inner surface on an upper side thereof and lacks a tapered inner surface on a lower side thereof, when said nozzle is in a dispensing position in which the first segment is horizontally oriented.

14. The system of claim 1 wherein a bottom surface of said first segment adjacent to said transition portion and a bottom surface of said second segment adjacent to said transition portion are generally aligned in a straight line extending in an axial direction.

15. The system of claim 1 wherein said transition portion includes a tapered inner surface and wherein an upstream axial end of said second segment, with respect to a direction of flow of fluid through said nozzle, is generally axially aligned with a downstream axial end of said tapered inner surface.

16. The system of claim 1 further comprising a fluid tube positioned in said nozzle and in fluid communication with said fluid path such that fluid flowing through said nozzle flows through said fluid tube.

17. The system of claim 1 wherein each of said cross section areas is a cross sectional area of said cavity.

18. The system of claim 1 wherein said transition portion generally gradually transitions from said first cross sectional area at one end thereof to said second cross sectional area at a second opposite end thereof along a length thereof.

19. The system of claim 1 wherein said transition portion transitions in a step-wise manner from said first cross sectional area at one end thereof to said second cross sectional area at a second opposite end thereof.

20. The system of claim 1 further comprising fluid storage tank filled with liquid petroleum-based fuel, and further comprising a pump configured to supply said fuel from the tank to the nozzle.

21. The system of claim 1 wherein the transition portion transitions asymmetrically relative to a center thereof.

22. A fluid dispensing nozzle comprising:
a nozzle body including a fluid path therein;
a fluid valve positioned in said fluid path and configured to selectively prevent or allow a flow of fluid through said fluid path;
a manually operable actuator operatively connectable to said fluid valve; and
a spout coupled to said nozzle body and having a cavity to allow fluid flowing through said fluid path to pass through said spout, said spout including a first segment having a generally uniform first cross sectional area along at least a portion thereof and a second segment having a generally uniform second cross sectional area along at least a portion thereof that is different than said first cross sectional area, wherein said first segment has a transition portion having a non-uniform cross sectional area along a length thereof, wherein said first segment and said second segment, at locations adjacent to said transition portion, each have a geometric center, and wherein said centers are not aligned, and wherein said first segment is made of a separate piece of material than said second segment.

23. The nozzle of claim 22 wherein said transition portion has a cross sectional area corresponding to said first cross sectional area at one end thereof and has a cross sectional area corresponding said second cross sectional area at a second opposite end thereof.

24. The nozzle of claim 22 wherein said first segment is a single unitary seamless piece of material, and is removably attachable to the second segment.

25. The nozzle of claim 22 wherein a downstream portion of the first segment, other than the transition portion, has a cross sectional shape and area that corresponds to a cross sectional shape and area of an upstream portion of the transition portion, and wherein an upstream portion of the second segment has a cross sectional shape and area that corresponds to a cross sectional shape and area of a downstream portion of the transition portion, and wherein a bottom portion of the downstream portion of the first segment, other than the transition portion, a bottom portion the upstream portion of the transition portion, a bottom portion of the upstream portion of the second segment, and a bottom portion of the downstream portion of the transition portion, are all generally aligned.

26. A fluid dispensing nozzle comprising:

a nozzle body including a fluid path therein;

a fluid valve positioned in said fluid path and configured to selectively prevent or allow a flow of fluid through said fluid path;

a manually operable actuator operatively connectable to said fluid valve; and a spout coupled to said nozzle body and configured to allow fluid flowing through said fluid path to pass through said spout, said spout including a first segment having a first cross sectional area along at least a portion thereof, a second segment having a second cross sectional area along at least a portion thereof that is different than said first cross sectional area, and a transition portion which has the first cross sectional area at one end thereof and the second cross sectional area at an opposite end thereof, wherein a bottom surface of a cavity of a downstream portion of said first segment, a bottom surface of a cavity of said transition portion, and a bottom surface of an upstream portion of a cavity of said second segment are generally aligned, and wherein said first segment is made of a separate piece of material than said second segment.

27. The nozzle of claim 26 wherein the first segment and the transition portion are made of a single unitary piece of material.

* * * * *